US005791162A

United States Patent [19]

Plath

[11] Patent Number: 5,791,162

[45] Date of Patent: Aug. 11, 1998

[54] METHOD AND SINKER FOR PRODUCING PLUSH FABRICS

[75] Inventor: Ernst-Dieter Plath, Albstadt, Germany

[73] Assignee: SIPRA Patententwicklungs- u. Beteiligungsgesellschaft mbH, Albstadt, Germany

[21] Appl. No.: 599,819

[22] Filed: Feb. 12, 1996

[30] Foreign Application Priority Data

Feb. 18, 1995 [DE] Germany ..... 195 05 646.9

[51] Int. Cl.[6] ..... D04B 1/02; D04B 9/12; D04B 15/06

[52] U.S. Cl. ..... 66/92; 66/104; 66/19

[58] Field of Search ..... 66/9 R, 19, 91, 66/92, 93, 104

[56] References Cited

U.S. PATENT DOCUMENTS

| | | | |
|---|---|---|---|
| 4,665,718 | 5/1987 | Jelinek et al. | 66/9 R |
| 4,989,421 | 2/1991 | Schmidt | 66/9 R |
| 5,239,843 | 8/1993 | Plath et al. | 66/93 |
| 5,511,393 | 4/1996 | Hu | 66/93 |

FOREIGN PATENT DOCUMENTS

| | | |
|---|---|---|
| 0594187 | 10/1993 | European Pat. Off. . |
| 3145307 | 11/1981 | Germany . |
| 4033735 | 4/1992 | Germany . |

*Primary Examiner*—John J. Calvert
*Attorney, Agent, or Firm*—Michael J. Striker

[57] ABSTRACT

The invention relates to a method, a knitting machine and sinkers (1, 2) for producing plush fabrics. The method is distinguished in that core and plush thread loops (48, 54) are preformed on selected sinker edges and are transferred prior to the actual stitch formation from these sinker edges to other preselected sinker edges by simple displacement of the sinkers (1, 2). For this purpose the knitting machine has first and second sinkers (1, 2), wherein the second sinkers (2) are provided with oblique faces (15). These are used, in the course of the transfer of the core thread loops (48) by means of retracting the first sinkers (1) and simultaneous advancement of the second sinkers (2), to act on the core thread loops (48) in such a way that the latter are securely enclosed in the slits of the first sinkers (1) when these are again advanced (FIG. 10).

9 Claims, 7 Drawing Sheets

METHOD AND SINKER FOR PRODUCING PLUSH FABRICS

Figure 1:
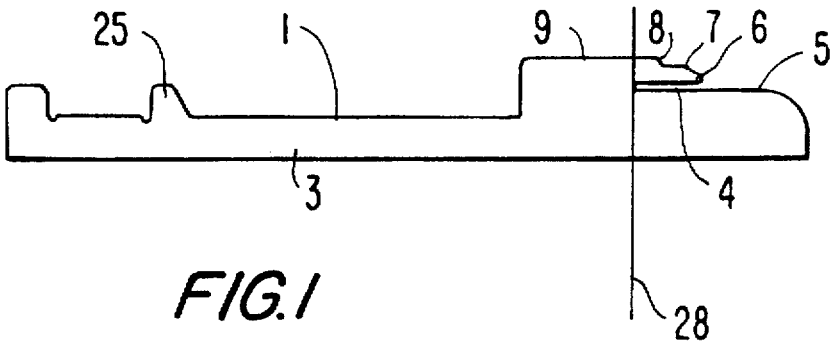

The invention relates to a method, a knitting machine and a sinker for producing plush fabrics having a base fabric and plush thread loops bound into it.

For forming a stitch row with knitting machines of this type, initially all ground and plush threads are preformed by means of sinker edges associated with them into ground and plush thread loops or bows before all preformed ground and plush thread loops are processed into stitches in a common system sector. By means of this it is possible, on the one hand, to insert a plush thread selected from a plurality of different plush threads into each ground or base thread stitch of a row and to create a very dense patterned plush fabric in this way. On the other hand, preforming of the base and plush threads has the purpose of making possible an even stitch formation with base and plush bows or stitches of equal length and to treat the threads gently in the process.

Essentially two methods are known up to now for producing such plush fabrics. One method (DE 40 33 735 A1) is distinguished in that the base thread bows are held on the sinkers which form them until the final stitch forming process starts. In contrast thereto, in the other method (EP 0 594 187 A1), immediately after having been preformed, the base thread loops are transferred from the sinker edges which form them to other sinker edges disposed on a lower level and are held on these until they are transferred to third sinker edges shortly before the stitch forming process. In doing so, the first mentioned method utilizes sinkers which are displaceably and tiltably seated, which is not always desirable, mainly for structural reasons, while the other method operates with sinkers which have additional edges located on an intermediate level, to which the transfer of the base thread loops is difficult and not always sufficiently assured. However, both methods and the associated knitting machines are distinguished by the advantage that the base as well as the plush thread bows are essentially continuously controlled and kept tight, such as is necessary for an even stitch design.

It is an object of this invention to provide a method for producing plush fabrics without tiltable sinkers and without transferring preformed base thread loops to an intermediate level.

A further object is to provide a method for knitting plush fabrics by combining the advantages of the two techniques mentioned above.

A further object of this invention is to provide a method which makes possible to substantially continuously control and keep tight the plush thread bows during knitting the plush fabric.

According to yet another object of this invention a knitting machine is to be provided which makes use of the method according to this invention.

A further object is to provide a knitting machine of the kind mentioned above without any tiltable sinkers.

Yet another object of this invention is to provide a sinker which can be used in the method as well as in the knitting machine according to this invention.

The above and other objects are solved in accordance with this invention by a method for producing plush fabrics which have a knit base fabric and plush thread loops bound into it, on a knitting machine with knitting tools having hooks and with first and second sinkers assigned to them in pairs, which can be radially advanced and retracted in the direction of the knitting tools and which are supplied with base threads and plush threads to produce base thread stitches and plush thread loops, comprising the steps of: initially raising (extending) knitting tools and inserting a base thread into the hooks thereof, preforming said base thread over first sinker edges of the first sinkers into base thread loops by a subsequent retraction of the raised knitting tools, again raising selected knitting tools and inserting at least one plush thread into the hooks thereof, preforming said plush thread over first sinker edges of the second sinkers into plush thread bows by a subsequent retraction of said selected knitting tools, transferring said preformed base thread loops from the first edges of the first sinkers to knock-off edges of the first sinkers, guiding the second sinkers into a retracted position for transferring the plush thread loops from the first edges of the second sinkers to the first edges of the first sinkers, and then retracting the knitting tools into the knock-off position to form stitches out of the base and plush thread loops.

The knitting machine for producing plush fabrics, which have a knit base fabric and plush thread loops bound into it, comprises in accordance with this invention a needle support, in which knitting tools intended for forming the base thread stitches and plush bows are movably seated; a sinker support, in which first and second sinkers intended for controlling the stitch formation are disposed in pairs, and movably seated, wherein the first sinkers have first edges intended for preforming the base thread loops and knock-off edges, and wherein the second sinkers have first edges intended for preforming the plush thread loops, at least one base thread guide for supplying a base thread; at least one plush thread guide for supplying a plush thread; a cam race arrangement for controlling the knitting tools and the sinkers, means for producing the base and plush thread stitches by inserting base and plush thread loops into knitting tools, retracting the knitting tools into an intermediate position for preforming base and plush thread loops by means of the sinkers and for then retracting the knitting tools into a knock-off position to form the base and plush thread stitches; controlling means for controlling the sinkers in such a way that immediately prior to the formation of base and plush thread stitches, the base thread loops are transferred from the first edges to knock-off edges of the first sinkers and the plush thread loops are transferred from the first edges of the second sinkers to the first edges of the first sinkers; and means on said second sinkers for pushing down the base thread loops during their transfer from the first edges to the knock-off edges of the first sinkers.

A sinker for a knitting machine for knitting plush fabrics comprises in accordance with this invention a recess above a flat underside and on its front end, which is delimited by an edge, which is parallel with the underside, and by an oblique face extending obliquely toward the front and upward, and that an upper edge, which is essentially parallel with the underside, is provided above the recess.

Figure 2:
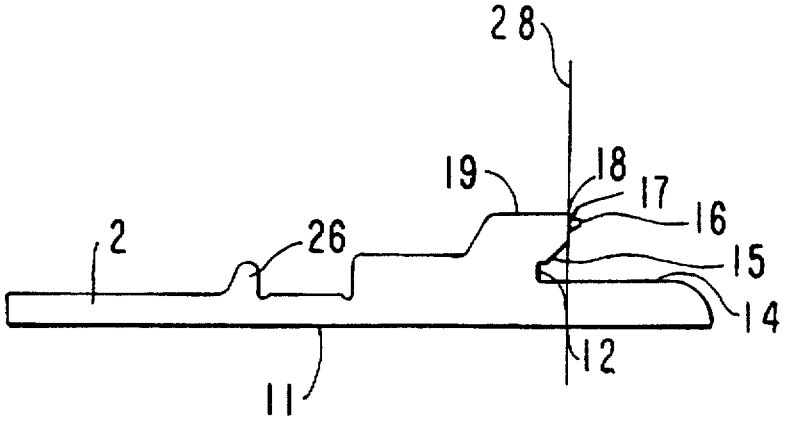
Figure 3:
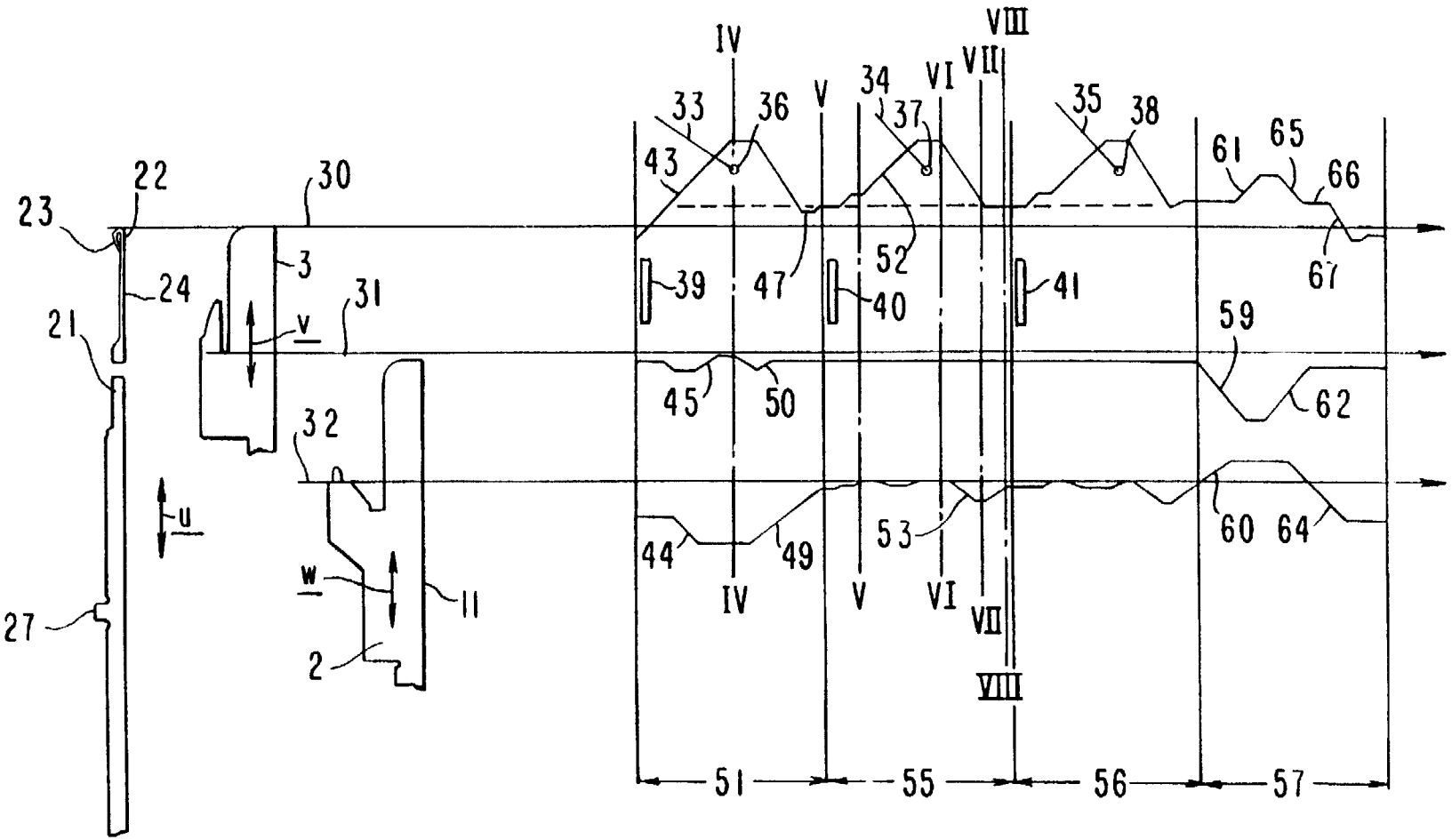
Figure 4:
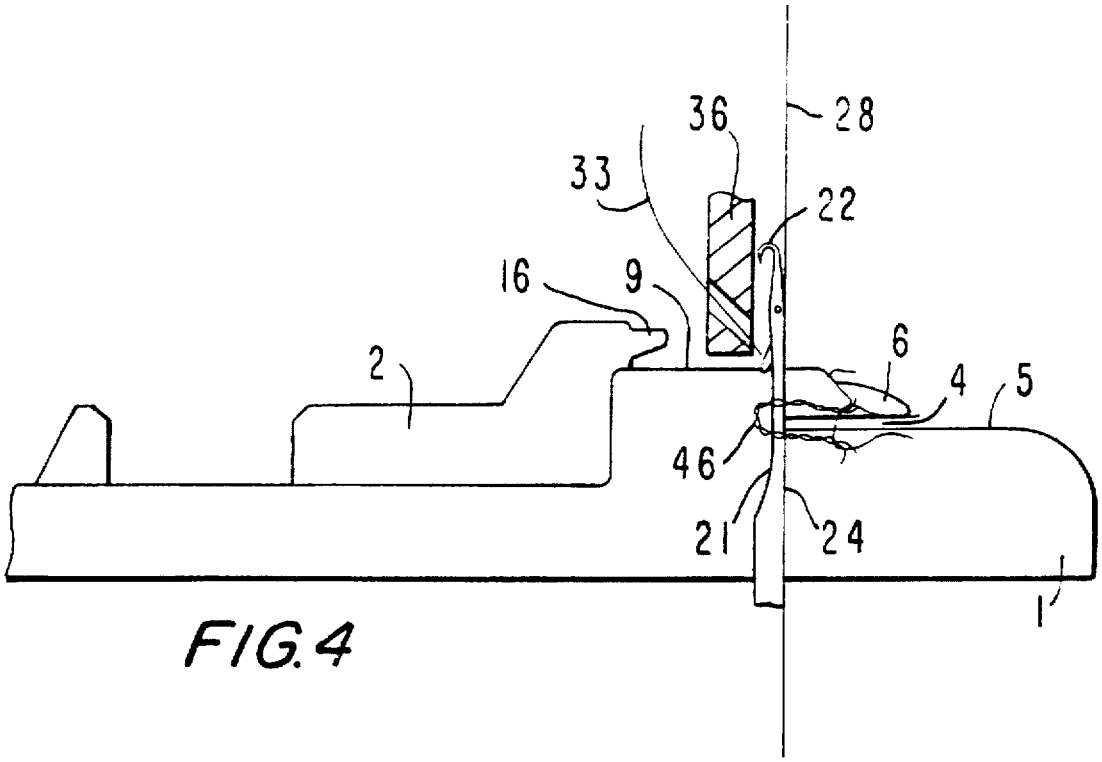
Figure 5:
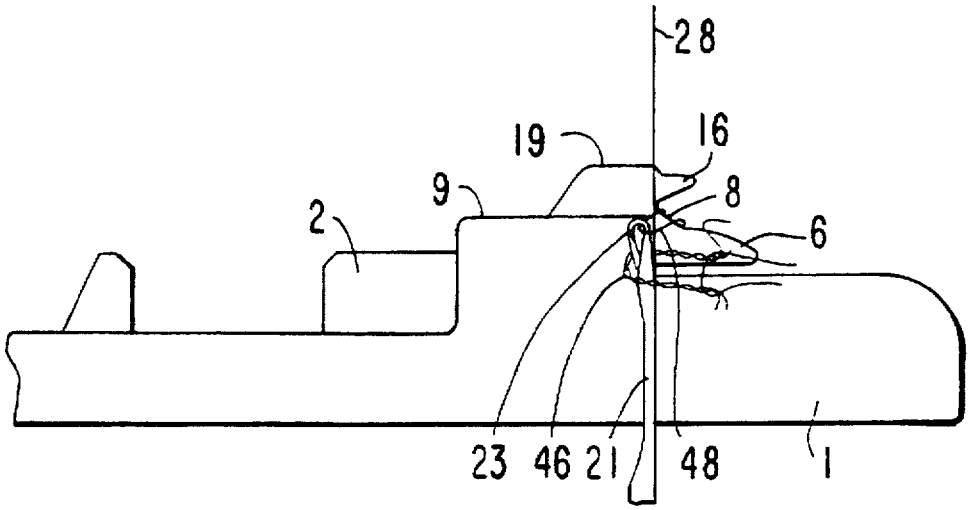
Figure 9:
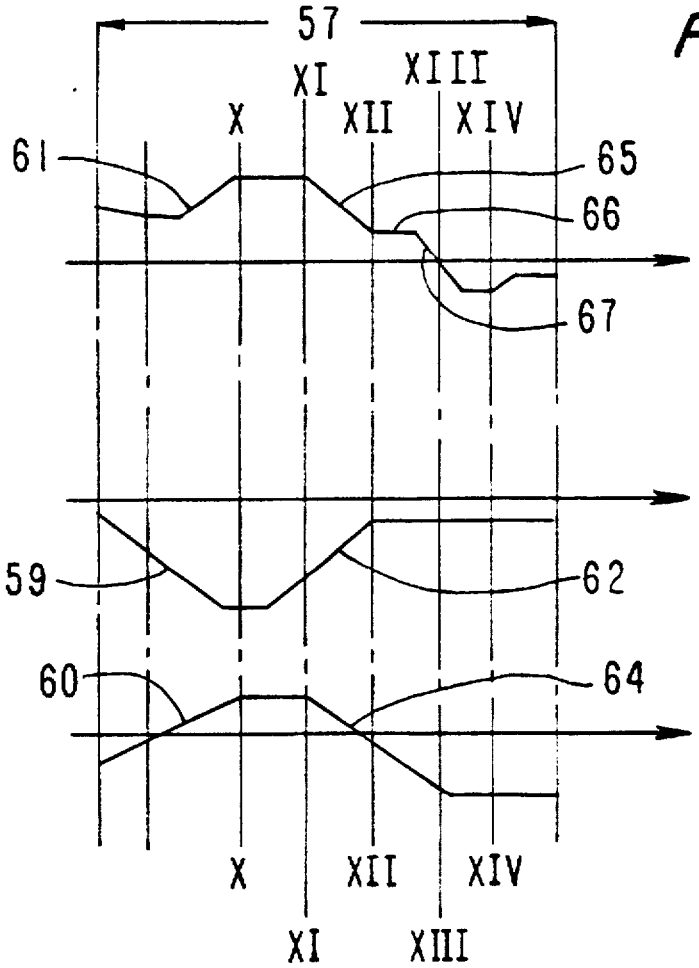

The invention will be explained in detail below by means of an exemplary embodiment in connection with the attached drawings. Shown are in:

FIGS. 1 and 2, details of sinkers employed in a circular knitting machine in accordance with the invention;

FIG. 3, a schematic top view of a cam race arrangement of a circular knitting machine in accordance with the invention, and of the knitting tools and sinkers used therein;

FIG. 4, a schematic representation on an enlarged scale along the line IV—IV of FIG. 3 of the relative positions of the knitting tools and sinkers in a system sector intended for inserting a base thread;

FIGS. 5 to 8, in representations corresponding to FIG. 4, the relative positions of the knitting tools and sinkers in a system sector intended for the insertion of a plush thread along lines V—V to VIII—VIII of FIG. 3;

FIG. 9, in a schematic representation enlarged in respect to FIG. 3, the relative positions of path sections of the cam race curves for the knitted fabrics and sinkers in a system sector of the cam race arrangement in accordance with FIG. 3 used for forming stitches;

FIGS. 10 to 14, in representations corresponding to FIG. 4, the relative positions of the knitting tools and sinkers in the system sector of FIG. 9 along lines X—X to XIX to XIV of FIG. 9.

The invention will be described below in connection with a circular knitting machine suitable for producing plush fabrics. Circular knitting machines of this type are known, for example from DE 31 45 307 A1 and DE 40 33 735 A1, whose contents are hereby expressly made the subject of the disclosure of the instant invention in order to avoid repetitions. In contrast with the known circular knitting machine, the circular knitting machine in accordance with the instant invention has a different cam race (FIG. 3) and a different type of sinker (FIG. 2), which will be explained in detail below.

The circular knitting machine in accordance with the invention has a knitting tool support, not shown, in the form of a rotatably seated needle cylinder and a sinker support, also not shown, in the form of a sinker disk rotatable with the needle cylinder. Sinkers 1 and 2, represented in FIGS. 1 and 2, are displaceably seated in customary grooves or channels of the sinker support, wherein the sinkers 1 can be called customary hold-down and knock-over sinkers, and the sinkers 2 can be called plush sinkers.

On their front ends and above their essentially flat undersides 3; the sinkers 1 respectively have a lower edge 5, which makes a transition into a linear slit 4, and a nib 6 located above it, which delimits the linear slit 4 with its underside and the lower edge 5 and is provided with an upper edge 7, whose back end is connected via a shoulder 8 with an edge 9 located still further back and above the nib 6. In this case the edges 9 and 5 essentially extend parallel with the underside 3, while the edge 7 is slightly downwardly beveled or bent, so that its distance from the edge 5 slowly diminishes, starting at a point located shortly ahead of the shoulder 8 up to a point formed at the front end of the nib 6. Furthermore, measured from the back end of the slit 4, the nib 6 is shorter than the edge 5.

In accordance with FIG. 2, above its essentially flat underside 11 the sinker 2 is provided with a recess 12, open toward its front, whose underside is delimited by a lower edge 14 extending as far as the front end of the sinker 2 and whose top is delimited by an oblique face 15 extending toward the front and obliquely upward. Ahead of the front end of the sinker 2, the oblique face 15 makes a transition into a nib 16 located above the edge 14 and, measured from the back end of the recess 12, is shorter than the latter. The nib 16 has on its top an edge 17 extending up to its front end, which makes a transition at its back end into a slightly higher edge 19 via a shoulder 18. In this case the edges 14, 17 and 19 are disposed essentially parallel with the underside 11. Furthermore, the distance of the edge 5 from the underside 3 of the sinker 1 is greater than the distance of the edge 14 from the underside 11 of the sinker 2, while at the same time the distance of the upper edge 9 from the underside 3 of the sinker 1 is less than the distance of the upper edge 19 from the underside 11 of the sinker 2. Finally, the distance of the point where the recess 12 makes a transition into the oblique face 15 from the underside 11 is preferable less than or at most equal to the distance of the underside of the nib 6 from the underside 3.

Knitting tools are displaceably seated in the needle cylinder of the circular knitting machine, which are embodied, for example, as customary latch needles 21 (FIG. 3) and have hooks 22, latches 23 and backs 24, by means of which they are displaceably guided on normally vertically extending bottoms of associated grooves formed in the needle cylinder. In addition, the sinkers 1 and 2 as well as the needles 21 have at least respectively one base 25, 26 or 27, which is controlled in a manner known per se by cam race elements, not shown, of a sinker or cylinder cam race.

To make understanding easier, a vertical line 28 is respectively drawn in FIGS. 1 and 2 as well as FIGS. 4 to 8 and 10 to 14, which identifies the level on which the backs 24 of the needles 21 or the associated groove bottom of the knitting tools supports are located.

FIG. 3 schematically shows a section of a cam race arrangement of the circular knitting machine suited for knitting two-colored plush fabrics. In this case, a line 30 indicates the position taken up by the hooks 22 of the needles 21 when they are in their circulating or non-knitting position. The position in which the sinker 1 is disposed in its position in which it is pushed forward farthest in the direction of the needles 21 or the needle cylinder axis is indicated by a line 31, i.e. in FIG. 1 in its position farthest toward the right and in FIG. 3 in its position farthest toward the top. Correspondingly, a line 32 indicates the relative position of the second sinkers 2. In this case the lines 31 and 32 essentially correspond to the line 28 in FIGS. 1, 2, 4 to 8 and 10 to 14, so that the downward displacement of the sinkers 1 and 2 in FIG. 3 corresponds to a radial withdrawal from the line 28 respectively to the left, and an upward displacement of the sinkers 1 and 2 corresponds to a radial displacement in the direction of the needles 21 or in the direction of the needle cylinder axis. Otherwise the possible movements of the needles 21 and sinkers 1 and 2 are indicated in FIG. 3 by arrows u, v and w.

The paths along which the needles 21 and the sinkers 1 and 2 can be guided during the knitting process are indicated in FIG. 3 by rising and descending curve sections, whose meaning will be individually explained further down below and which are realized in a manner known per se by means of appropriately shaped cam race elements or the like, which act on the bases 25 to 27 of the needles 21 or of the sinkers 1 and 2 and have been omitted in FIG. 3 to simplify the representation.

Yarn guides 36 to 38 are provided in a known manner for supplying a core thread 33, a first plush thread 34 having a first property, for example color, and a second plush thread 35 with a second property, for example color. To select those needles 21 which are intended to take up any one of the threads 33 to 35, selection devices 39, 40 and 41 are associated in a manner also known per se with the needles 21 or jack selectors or the like associated with them, which cooperate with correspondingly designed cam race elements.

When employing the circular knitting machine explained by means of FIG. 3, the production of a two-colored plush fabric takes place in the manner described below. In this case the method steps explained by means of FIGS. 4 to 8 correspond to the known method steps (DE 31 45 307 A1 or DE 40 33 735 A1), in spite of the employment of different sinkers, while the method steps in accordance with FIGS. 10 to 14 are novel and based on the differently designed sinkers 2. Otherwise it has been generally assumed that this is a circular knitting machine with a rotatable needle cylinder and fixed cam race arrangement, although this could also be reversed. The direction of running of the needles 21 and sinkers 1 and 2 follows from the arrow tips at the ends of the lines 30 to 32.

Viewed in the knitting direction, the cam race arrangement contains a first path section 43, along which all needles 21 are first pushed into their highest position (FIG. 4). In the process, the sinkers 2 are slowly moved along a path section 44 into their fully retracted position (FIG. 4) in order to make room for the core thread guide 36, while the sinkers 1 first are in the customary hold-down position, but then are pushed slightly forward (path section 45 in FIG. 3) in order to tighten with their shoulder 8 the plush bows on their nibs 6 and formed in the previous method step. Then all needles 21 pick up the core thread 33 (FIG. 4) which is supplied by the core thread guide 36, while all old stitches 46 reach the shafts of the needles 21 via the opening latches 23. Then all needles 21 are pulled into an intermediate position (path section 47 in FIG. 3) which is located higher than would correspond to the non-knitting position (line 30), but nevertheless is low enough for forming core thread loops 48 (FIG. 5) and to preform them over the upper edges 9, used for preforming, of the fully extended first sinkers 1. In this process the latches 23 of the needles 21 are again closed by the old stitches 46. However, the old stitches 46 are not yet knocked off.

Following the passage of the core thread guide 33, the second sinkers 2 are again advanced through the path section 49, while the first sinkers 1 are first briefly retracted and then advanced into the normal hold-down position (path section 50 in FIG. 3) in order to arrange the base thread loops 48 ahead of the shoulders 8 and to push them through these behind the needle back 24 and to tighten them or to keep them tightened. All of these method steps are performed in a first system sector 51 (FIG. 3).

Figure 6:
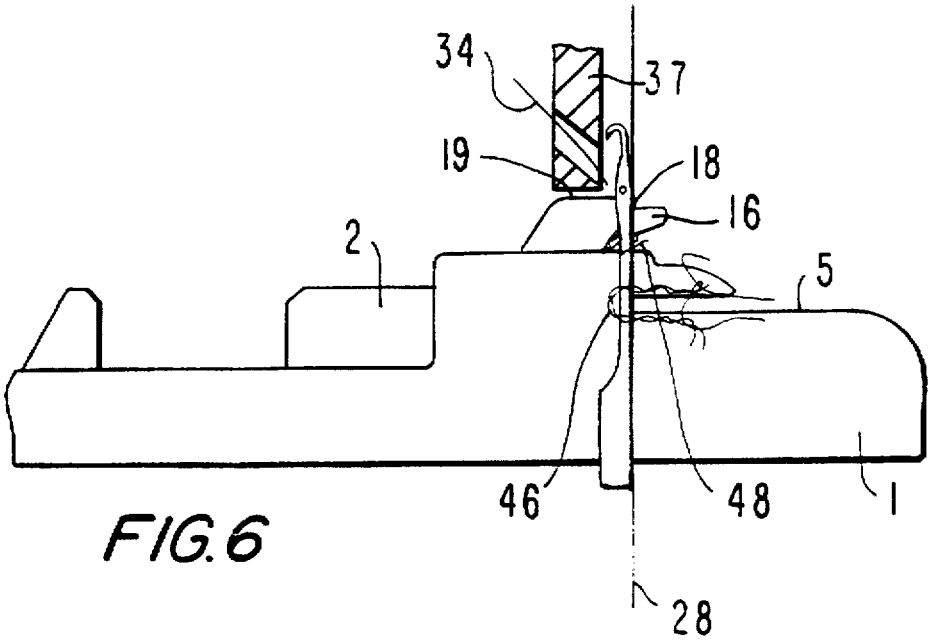
Figure 7:
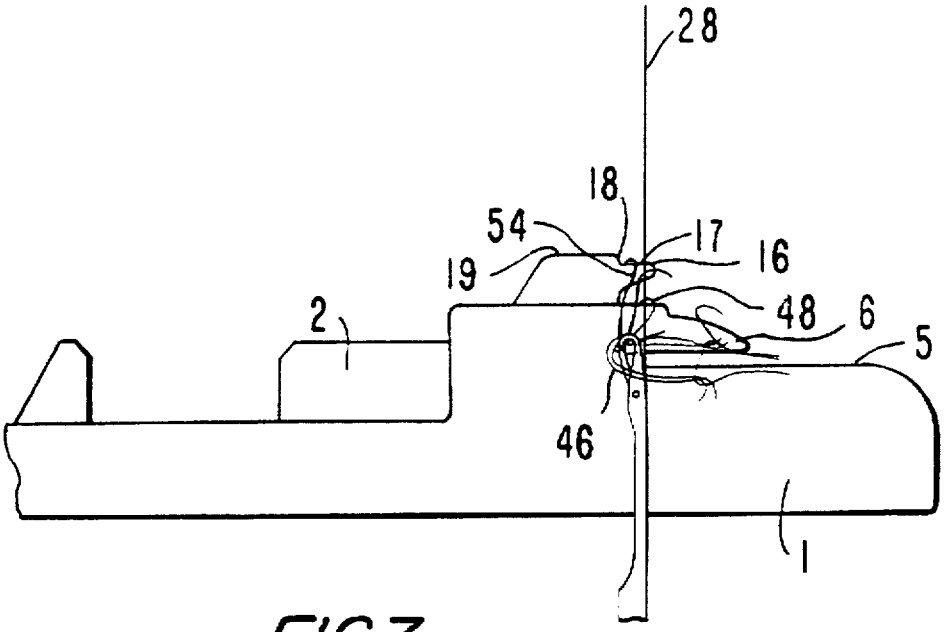
Figure 8:
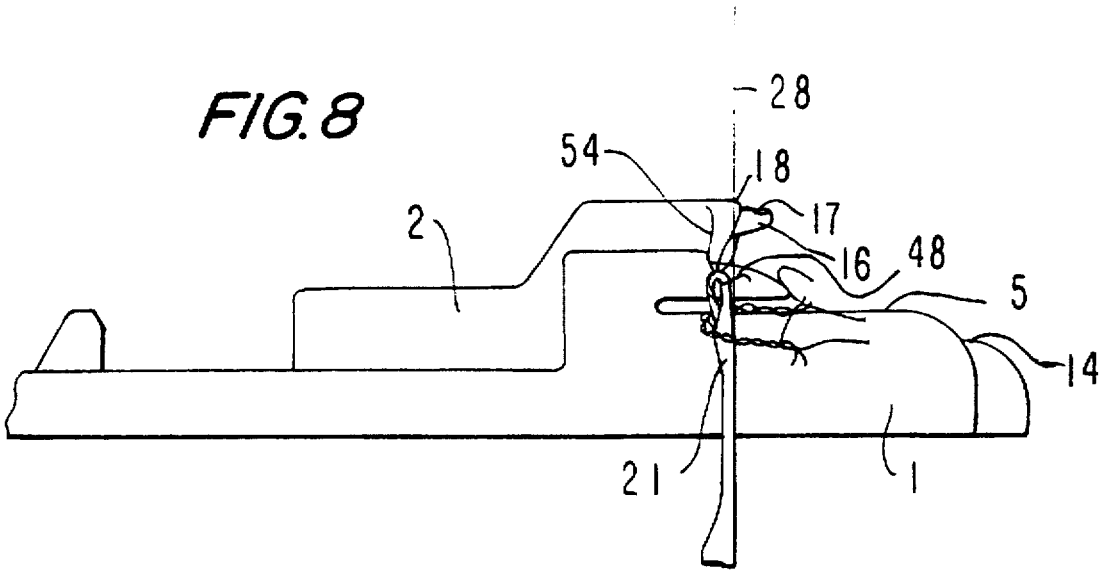

When entering a further path section 52, the needles 21 which are intended to pick up the plush thread 34 presented by the plush thread guide 37 (FIGS. 3, 6) are selected by means of the selecting device 40. The heads of these needles 21 are then lifted from the path section 52 to receive the plush thread (FIG. 6) and are afterward pulled back into the intermediate position (FIG. 7). In the process, the plush thread 34 is first pulled over the upper edges 19, used for preforming, of the second sinkers 2 wherein, in contrast to the core thread guide 36, the plush thread guide 37 is not disposed closely above the upper edges 9 of the sinker 1, but above the upper edges 19 of the sinkers 2 (FIG. 6). In spite of this position of the plush thread guide 37, the previously formed core thread loops 48 cannot slip under the ends of the opening needle latches 23 when the needles 21 are pushed out into the position suitable for receiving the plush thread 34, since the geometry has been selected such that the upper edges 19 of the sinkers 2 are located no higher above the edges 7 holding the core thread loops 48 of the sinkers 1 than is necessary to keep the core thread loops 48 securely on the opened latches 23 (caught on the needle).

After a renewed retraction of the needles 21 into the intermediate position (FIG. 7), the sinkers 2 are briefly retracted (FIG. 7) by means of a path section 53 (FIG. 3), because of which freshly formed plush thread loops 54 slip off the upper edges 19 over the shoulders 18 to the slightly lower located edges 17 of the nibs 16 of the sinkers 2 and relax, so that the danger of high thread tension or thread breaks is reduced.

During this method step the sinkers 1 essentially remain in their hold-down position while those needles 21 which are not to pick up the plush thread 34 remain in the intermediate position (path section 47 or dashed line in FIG. 3), so that their hooks 22 are kept closed by the old stitches 46 and otherwise closely below the upper edges 9 of the sinkers 1. All these method steps are performed in a second system sector 55 (FIG. 3).

The insertion of the second plush thread 35 into selected needles 21 takes place analogously with the above description in a third system sector (FIG. 3), wherein as a rule those needles 21 pick up the second plush thread 35 which have not picked up the first plush thread 34, and vice versa. In order to prevent in the course of this that selected needles 21 pierce the already formed plush thread loops 54, following their transfer to their edges 17, the sinkers 2 are again advanced through the path section 53 (FIG. 3) far enough so that the previously formed plush thread loops 54 or float stitches located between them are pushed by the shoulders 18 behind the back 24 of the needles 21. This results finally in the position in accordance with FIG. 8.

In the further course it is possible to provide further system sectors corresponding to the system sectors 55 and 56 in order to be able, if required, to supply plush threads with further properties, for example colors. In any case, positions of the individual functional elements which can essentially be seen in FIG. 8 result at the end of such path sections, wherein respectively one core thread loop 48 and a selected plush thread bow 54 are in the hooks of the needles 21 and the core thread loops 48 rest on the edges 7 of the nibs 6, but the plush thread bows 54 rest on the edges 17 of the nibs 16.

The old stitches 46 (FIG. 7) are now knocked off over the preformed new core thread and plush thread loops 48 or 54 in such a way that the latter essentially remain continuously under the control of the sinkers 1 and 2, because these are brought from the intermediate position into the knock-off position in the course of further retraction of the the needles 21 in such a way that they continuously keep the preformed plush thread loops 54 tightened. However, prior to the stitch formation the core thread loops 48 are transferred to the lower edges 5 of the sinkers 1 and the plush thread loops 54 to the upper edges 7 of the nibs 6 of the sinkers 1. In the exemplary embodiment this process, as well as the final formation of stitches, takes place in a fourth system sector 57 (FIG. 3), represented enlarged in FIG. 9.

Figure 10:
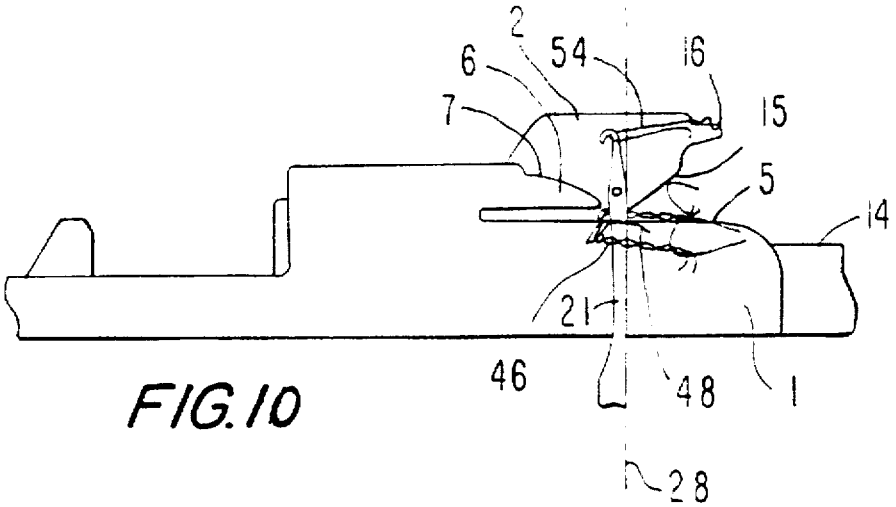

First the core thread loops 48 are transferred. For this purpose the first sinkers 1 are retracted, starting from the position shown in FIG. 8, along a path section 59 radially outward so that the core thread loops 48 slowly slide along the upper edge 7 of the nibs 6 downward on the edges 5 used for knocking off the stitches (FIG. 10). The lower edges 14 of the sinkers 2 cannot interfere with this process since they are disposed lower than the edges 5, as clearly shown in FIG. 10. The transfer process is further aided in that the second sinkers 2 are simultaneously pushed forward along a path section 60 (FIG. 9), so that the respective oblique faces 15 (FIG. 2) of the sinkers advancing in the direction of rotation of the needle cylinder act on the stitch bases of the core thread loops 48 located on the following sinkers 1 in such a way that they are slowly pushed more and more downward. In order to prevent in this process the tearing of the plush thread loops 54 located in front of the shoulders 18 of the sinkers 2, the needles 21 are simultaneously lifted, corresponding to the advance of the sinkers 2, along a path section 61 during this process. By means of this the safe transfer of the core thread loops 48 from the edges 7 to the edges 5 of the sinkers 1 is possible, even though the needles 21 do not exert a pull.

Figure 11:
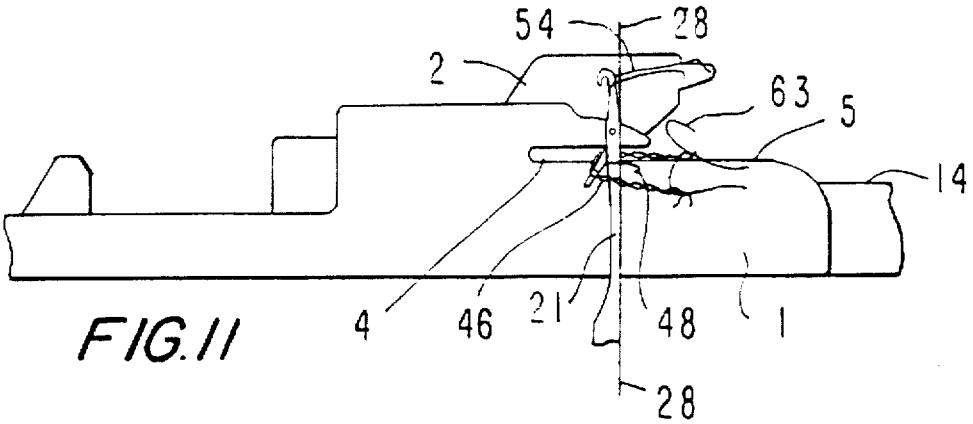
Figure 12:
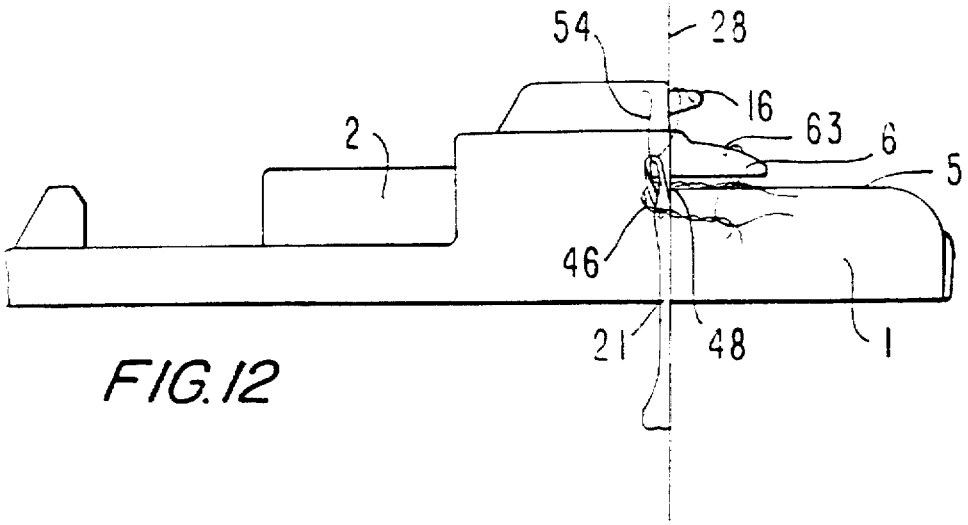

Immediately following the described process, the sinkers 1 are pushed forward again along a path section 62. Since the lowest portions of the oblique faces 15 end at the level of the upper edges of the sinkers 1 delimiting the slit, or lower (FIGS. 1 and 2), the core thread loops 48 safely enter the slits 4 of the sinker 1 in this process, while they are kept tight by the sinkers 2 (FIG. 11). Furthermore, the nibs 6 of the sinkers 1, in a manner known per se, take up the plush bows 63 formed in a previous method step, so that they are re-tightened as shown in FIG. 12.

Figure 13:
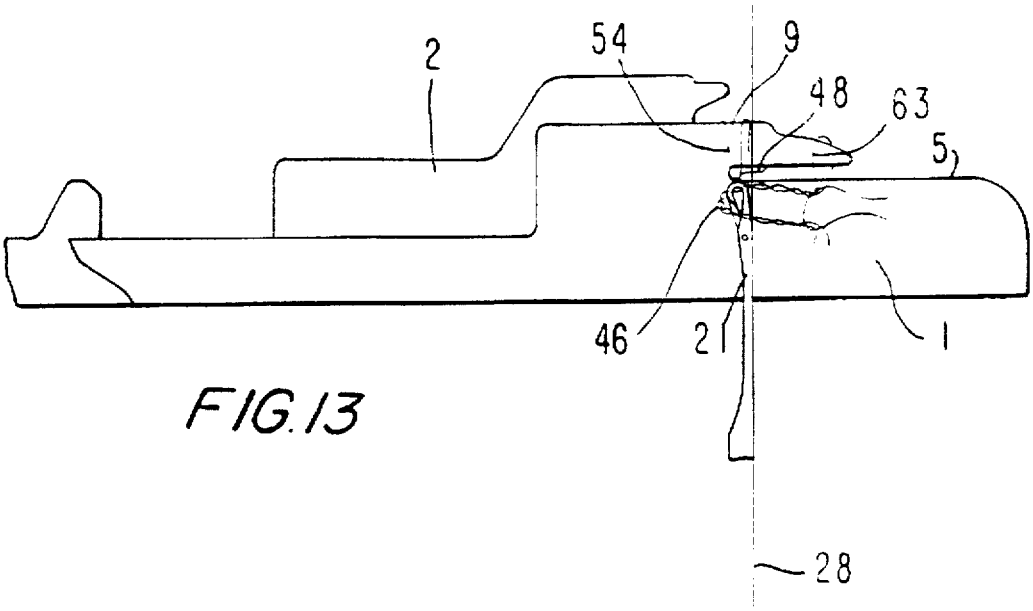
Figure 14:
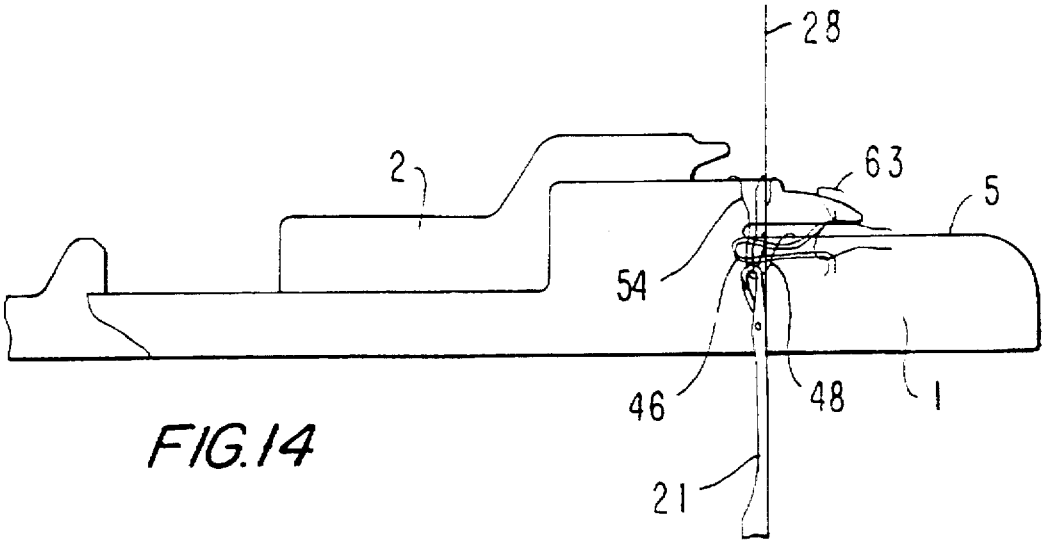

During the advancement of the sinkers 1 along the path section 62, the sinkers 2 are pulled back again along a path section 64 (FIG. 9). In order to keep the plush thread loop 54 tight and under control during this, the needles 21 are correspondingly lowered along a path section 65 (FIG. 9) simultaneously. In the course of this the plush thread loops (54) slowly reach the frontmost tips of the nibs 16 (FIG. 12) until, during the continued retraction of the sinkers 2 along the path section 64, they fall from the nibs 16 to the upper edges 9 of the sinkers 1, which are now located underneath the nibs and are used for knocking off (FIG. 13). Since during this process the needles 21 continue to be retracted (path section 67 in FIG. 9), except for a short period of time used for the unhampered sliding off from the nibs 16 (path section 66 in FIG. 9), the plush thread bows 54 are for all practical purposes continuously guided and kept tightened in a controlled manner, so that a reformation of the plush thread bows 54 is prevented even with the occurrence of critical float stitches.

In the position in accordance with FIG. 13 the plush thread loops 54 are guided on the upper knock-off edges 9 and the core thread loops 48 on the lower knock-off edges 5 of the sinkers 1. Stitch formation takes place from this position (FIG. 14), wherein in accordance with FIG. 9 the sinkers 1 are held in their advanced position and the sinkers 2 in their retracted position and the needles 21 are simultaneously retracted along the path section 67 into their lowest position. By means of this the core thread and the plush thread loops 48, 54 are pulled through the old stitches 46 while forming new stitches and the old stitches 46 are knocked off. The basic position which can also be seen in FIG. 3 and which is present at the start of the system sector 51, again occurs at the end of the system sector 57.

In comparison with circular knitting machine with tiltable sinkers (DE 40 33 735 A1), the described circular knitting machine has the advantage that there are only sinkers moved in straight lines, because of which the sinker cam race can be made structurally more simple. In comparison with circular knitting machines in which the core thread loops are first deposited on an intermediate level (EP 0 594 187 A1) the essential advantage, besides the simplification of the sinker cam race, is achieved that no problems arise during the transfer of the core thread loops to the knock-off edges 5 of the sinkers 1. This advantage is considerable in particular in those cases where not only plush threads with different properties, but also several core threads are to be worked into a single row in a manner known per se (DE 39 27 815 A1). In this case it is possible to provide, for example between system sectors 51 and 55 (FIG. 3), a further system sector 51, wherein the selecting devices 39 can be used to drive out the needles 21 for selecting one or the other core thread. It is understood here that it is also possible to provide structural connections of different connecting elements in the knit backing fabric.

The invention is not limited to the described exemplary embodiment, which can be changed in numerous ways. For example, the invention offers the essential advantage that the system sectors 51, 55, 5G and 57 represented in FIG. 3 can essentially be designed to be of the same length, even with an optimization of knitting techniques. Therefore, in a preferred embodiment, one or several system sectors 51 for core threads are provided at the circumference of the circular knitting machine, depending on the field of application, for each complete system, and also an arbitrary number of further system sectors 55, 56 for plush threads, and then a system sector 57. It is possible in this way to arrange, for example, a total of 72 system sectors at the circumference of a 30" circular knitting machine which means, that with two-colored (four-colored) plush fabrics with respectively one core thread section, a total of 18 (12) complete systems are available and therefore 18 (12) rows per cylinder revolution can be produced. It is alternatively possible to provide a cam race segment which makes possible all needle and sinker control functions to be seen in FIG. 3; i.e. contains all system sectors 51, 55, 56 and 57, and can be reset or rebuilt when needed. It is furthermore understood that the described circular knitting machine can also be used for producing non-patterned plush fabrics. In all cases the core and plush threads are treated very gently because of preforming. The application of the method of the invention furthermore is not limited to the circular knitting machine represented only by way of example, but is also possible in connection with other circular knitting machines as well as flat bed knitting machines. This also applies to the control of the needles and sinkers, which can be controlled, for example, by cam race elements running between two bases or in an appropriate recess. It is furthermore possible to execute the method steps described by means of FIGS. 4 to 8 and 10 to 14 in a partially overlapping manner, as is shown in particular by the relative positions of the individual path sections in respect to each other in FIG. 3. Finally, it is obvious to one skilled in the art that by means of an appropriate control of the sinkers 1 and 2 it is possible to preform the core thread loops 48 also via the edges 7 of the sinkers 1 and the plush thread bows 54 via the edges 17 of the sinkers 2, i.e. it is possible to utilize both the edges 7 and 9 as well as the edges 17 and 19 for preforming. In other words, it would be conceivable to provide sinkers 1 and 2 which only have the edges 7, 17 or the edges 9, 19.

I claim:

1. A method of making a plush fabric having a knit base fabric and plush thread loops bound into the knit base fabric with a knitting machine, knitting machine comprising knitting tools having hooks and first and second sinkers assigned to the knitting tools in pairs, the sinkers being radially advanced and retracted in the direction of the knitting tools, and means for feeding base threads and plush threads to produce stitches and loops therefrom, the method comprising the steps of: initially raising the knitting tools and feeding a base thread onto the hooks thereof; preforming the base thread over the first sinker edges of the first sinkers into base thread loops by a subsequent retraction of the raised knitting tools; again raising selected knitting tools and feeding at least one plush thread onto the hooks, preforming the at least one plush thread over first sinker edges of the second sinkers into plush thread loops by a subsequent retraction of the selected knitting tools, transferring the preformed base thread loops from the first sinker edges of the first sinkers to knock-off edges of the first sinkers and at the same time holding down the base thread loops by advancing the second sinkers and holding taut the preformed plush loops by raising said knitting tools; guiding the second sinkers into a retracted position for transferring the plush thread loops from the first sinker edges of the second sinkers to the first sinker edges of the first sinkers and simultaneously retracting the needles for holding taut the plush loops during transferring step; and then retracting the knitting tools into a knock-off position to form stitches out of the base thread loops and the plush thread loops.

2. A method according to claim 1; further comprising during knitting at first said base, transferring thread loops to knock-off edges of the first sinkers, and thereafter transferring the plush thread loops to the first sinker edges of the first sinkers.

3. A method according to claim 2; further comprising preventing tearing of the plush thread loops during advancement of the second sinkers by simultaneously advancing the needles.

4. A method according to claim 1; further comprising after transfer of the base thread loops to nock-off edges of the first sinkers, holding the thread base loops down by again advancing the first sinkers.

5. A knitting machine for producing plush fabrics which have a knit base fabric and plush thread loops bound into it, comprising: a needle support movably mounting knitting tools having hooks for forming stitches and loops with a base thread and at least a plush thread; a sinker support movably mounting first and second sinkers for controlling stitch and loop formation, said sinkers being disposed in pairs and wherein the first sinkers have first edges and second edges whereas the second sinkers have first edges; at least one base thread guide for feeding the base thread into the hooks of the knitting tools; at least one plush thread guide for feeding said plush thread into selected ones of said hooks; and a cam arrangement for controlling the knitting tools and the sinkers during loop and stitch formation, said cam arrangement having means for advancing and retracting the knitting tools into an intermediate position for preforming base thread loops over said first edges of said first sinkers, means for advancing and retracting said knitting tool for preforming plush thread loops over said first edges of said second sinkers, means for retracting and advancing said first and second sinkers in a longitudinal direction thereof for transferring said base thread loops from said first edges of said first sinkers to said second edges of said first sinkers and for transferring said plush thread loops from said first edges of said second sinkers to the first edges of said first sinkers, means for holding taut said plush thread loops during said transferring steps by a combined movement of said sinkers and said knitting tools, and means for retracting the knitting tools into a knocking-off position to form base and plush thread stitches from said loops, said second sinkers having means for pushing down the base thread loops during their transfer from the first edge to the second edges of the first sinkers.

6. A knitting machine according to claim 5, wherein said means for pushing down said base thread loops are oblique faces on said second sinkers.

7. A knitting machine in accordance with claim 6, wherein said second sinkers have a front end with a recess which is delimited by a lower edge and said oblique face, and that the edges used for preforming the plush thread loops are disposed above said recess.

8. A knitting machine in accordance with claim 5, wherein said first edges of said first sinkers are located above said edges of said first sinkers, and said first edges of the second sinkers are located above the first edges of the said sinkers.

9. A knitting machine according to claim 1, wherein said first sinkers are displaceable in such a way that their first edges are used both for preforming the base thread loops as well as for receiving the plush thread loops during a stitch formation.

* * * * *